US009722305B2

(12) United States Patent
Feldman et al.

(10) Patent No.: US 9,722,305 B2
(45) Date of Patent: Aug. 1, 2017

(54) BALANCED MULTI-LAYER PRINTED CIRCUIT BOARD FOR PHASED-ARRAY ANTENNA

(71) Applicant: Google Inc., Mountain View, CA (US)

(72) Inventors: Arnold R. Feldman, San Francisco, CA (US); Paul Swirhun, Los Gatos, CA (US); Leesa Marie Noujeim, Los Altos, CA (US); Dave Moloney, Los Gatos, CA (US); Roy Michael Bannon, Palo Alto, CA (US); Paul James Husted, San Jose, CA (US); Michael J. Buckley, Marion, IA (US)

(73) Assignee: Google Inc., Mountain View, CA (US)

( * ) Notice: Subject to any disclaimer, the term of this patent is extended or adjusted under 35 U.S.C. 154(b) by 85 days.

(21) Appl. No.: 14/830,981

(22) Filed: Aug. 20, 2015

(65) Prior Publication Data

US 2017/0054205 A1 Feb. 23, 2017

(51) Int. Cl.
*H01Q 1/38* (2006.01)
*H01Q 21/00* (2006.01)
(Continued)

(52) U.S. Cl.
CPC ..... *H01Q 1/38* (2013.01); *H01Q 1/42* (2013.01); *H01Q 21/00* (2013.01);
(Continued)

(58) Field of Classification Search
CPC ..... H01Q 1/085; H01Q 1/246; H01Q 21/08; H01Q 9/0414; H01Q 1/38; H01Q 1/42;
(Continued)

(56) References Cited

U.S. PATENT DOCUMENTS 5,216,435 A 6/1993 Hirata et al.
5,849,234 A 12/1998 Harrison et al.
(Continued)

FOREIGN PATENT DOCUMENTS

EP 1551079 A1 7/2005
JP 5167331 A 7/1993

OTHER PUBLICATIONS

International Search Report and Written Opinion for related PCTApplication No. PCT/US2016/037576 dated Oct. 13, 2016.

*Primary Examiner* — Tho G Phan
(74) *Attorney, Agent, or Firm* — Honigman Miller Schwartz and Cohn LLP

(57) ABSTRACT

A phased-array antenna assembly includes an antenna board stack, a radome configured to cover the antenna board stack, and a casing configured to support the antenna board stack. The antenna board stack includes a central core, a bottom antenna unit defining a bottom thickness between a bottom surface of the central core and a bottom end of the antenna board stack, and a top antenna unit defining a top thickness between a top surface of the central core and the top end of the antenna board stack that is substantially equal to the bottom thickness. The bottom antenna unit includes two spaced apart bottom metal layers each associated with a different distance from the axis of symmetry. The top antenna unit includes two spaced apart top metal layers each associated with a corresponding one of the distances from the axis of symmetry associated with the bottom metal layers.

30 Claims, 10 Drawing Sheets

(51) Int. Cl.
*H01Q 1/42* (2006.01)
*H01Q 21/26* (2006.01)

(52) U.S. Cl.
CPC ..... *H01Q 21/0075* (2013.01); *H01Q 21/0087* (2013.01); *H01Q 21/26* (2013.01)

(58) Field of Classification Search
CPC .... H01Q 21/00; H01Q 21/26; H01Q 21/0075; H01Q 21/0087
USPC ..... 343/700 MS, 725, 727, 795, 829, 846, 343/853, 872
See application file for complete search history.

(56) References Cited

U.S. PATENT DOCUMENTS 6,018,320 A 1/2000 Jidhage et al.
6,154,176 A * 11/2000 Fathy ..... H01Q 1/38 343/700 MS
6,239,764 B1 * 5/2001 Timofeev ..... H01Q 1/523 343/700 MS
6,366,244 B1 4/2002 Fernandes
6,392,600 B1 * 5/2002 Carson ..... H01Q 1/246 343/700 MS
6,407,704 B1 6/2002 Franey et al.
6,856,290 B1 * 2/2005 Ryken ..... H01Q 1/40 343/700 MS
6,947,008 B2 * 9/2005 Tillery ..... H01Q 1/085 343/824
7,439,919 B2 * 10/2008 Jansen ..... H01Q 1/243 343/700 MS
2010/0167666 A1 7/2010 Choudhury et al.
2014/0028520 A1 1/2014 Huynh
2014/0300521 A1 10/2014 Junemann
2015/0087522 A1 3/2015 Kawaguchi et al.
2015/0116184 A1 4/2015 Curran et al.

* cited by examiner

BALANCED MULTI-LAYER PRINTED CIRCUIT BOARD FOR PHASED-ARRAY ANTENNA

TECHNICAL FIELD

This disclosure relates to a phased-array antenna implemented on a balanced printed circuit board.

BACKGROUND

Electronically steerable phased-array antennas may be implemented on multilayer printed circuit boards (PCBs) by stacking multiple planar layers together that include manifold layers and radiating element layers to achieve an antenna far field pattern at a desired frequency. In addition to using expensive low loss dielectrics and embedded thin film resistor layers, conventional antenna printed circuit board stacks are unbalanced due the use of lower order Floquet mode scattering techniques to achieve desired radio frequency (RF) performance and the use of stripline manifolds to eliminate system resonances. Moreover, multiple lamination cycles are needed to manufacture all of the layers for the printed circuit board stack. Accordingly, conventional phased array antenna printed board stacks are associated with high manufacturing and material costs unsuitable for use in broadband wireless Internet access with low-cost, high volume consumer electronics.

Radomes may be used to protect antenna board stacks from weather elements such as rain, snow, and/or debris-build up. Radomes are generally assembled from an expensive multilayer structure and spaced two wave lengths away from the antenna board stack to achieve reasonable RF performance. While radomes may protect the antenna board stacks, the pooling of water and/or snow upon the outer surfaces of the radomes, may adversely impacts the RF performance of the phased-array antenna implemented on the antenna board stack underneath. In order to address the pooling of water and/or snow upon the outer surfaces of the radomes, the radomes may have curved surfaces increasing the physical volume of the radomes and reducing RF performance due to the increased angle of incidence of the incident electromagnetic fields on the radomes. Accordingly, conventional radomes are associated with high manufacturing and material costs unsuitable for use in broadband wireless Internet access with low-cost, high volume consumer electronics.

Additionally, a casing may be used to house and support antenna board stacks above a ground surface as well as protect exposed surfaces of the antenna board stack from the weather elements not covered by the radome. The casing, when in direct contact with a bottom surface of the antenna board stack, may create resonance implications that negatively impact the RF performance of the antenna board stack.

SUMMARY

One aspect of the disclosure provides a phased-array antenna that includes an antenna board stack, a radome, and a casing. The antenna board stack defines a thickness between a bottom end and a top end and includes a central core layer, a bottom multilayer antenna unit and a top multilayer antenna unit. The central core layer includes a bottom surface and a top surface disposed on an opposite side of the central core layer than the bottom surface, and defines an axis of symmetry bisecting the bottom surface and the top surface to divide the thickness of the antenna board stack in half. The bottom multilayer antenna unit defines a bottom thickness between the bottom surface of the central core layer and the bottom end of the antenna board stack, the bottom multilayer antenna unit includes two spaced apart bottom metal layers each associated with a different distance from the axis of symmetry. The top multilayer antenna unit defines a top thickness between the top surface of the central core layer and the top end of the antenna board stack that is substantially equal to the bottom thickness of the bottom multilayer antenna unit. The bottom multilayer antenna unit includes two spaced apart top metal layers each associated with a corresponding one of the distances from the axis of symmetry associated with the bottom metal layers. The radome is configured to cover the top end of the antenna board stack and includes an outer surface and an inner surface disposed on an opposite side of the radome than the outer surface and opposing the top end of the antenna board stack. The casing is configured to support the antenna board stack above a ground surface, and includes an interior surface opposing the bottom end of the antenna board stack and a ground-engaging surface disposed on an opposite side of the casing than the interior surface.

Implementations of the disclosure may include one or more of the following optional features. In some implementations, the first multilayer antenna unit includes a first bottom layer, a second bottom metal layer, a first bottom dielectric spacer, a radio frequency manifold layer and a second bottom dielectric spacer. The first bottom metal layer is disposed on the bottom surface of the central core layer and the first bottom dielectric spacer is disposed between the first metal layer and the second bottom metal layer. The radio frequency manifold layer is disposed at the bottom end of the antenna structure and the second bottom dielectric spacer is disposed between the second metal layer and the radio frequency manifold layer. The second multilayer antenna unit may include a first top metal layer disposed on the top surface of the central core layer and including a thickness substantially equal to a thickness of the first bottom metal layer and a second top metal layer including a thickness substantially equal to a thickness of the second bottom metal layer. The second multilayer antenna unit may also include a first top dielectric spacer separating the first top metal layer and the second top metal layer and including a thickness substantially equal to a thickness of the first bottom dielectric spacer and a second top dielectric spacer disposed on an opposite side of the second top metal layer than the first top dielectric spacer and including a thickness substantially equal to a thickness of the second bottom dielectric spacer.

In some examples, the first bottom metal layer, the first top metal layer, and the second top metal layer each include a corresponding antenna. The second bottom metal layer may include a ground plane shared by each of the antennas. Each of the antennas may include a different metal pattern. The antenna assembly may include one or more cross dipoles disposed electrically between metal patches defined by the metal pattern associated with at least one of the antennas. The first and second bottom metal layers, the first and second top metal layers, and the radio frequency manifold layer may be connected by at least one probe feed via extending between the top and bottom ends of the antenna board stack.

In some implementations, the first bottom dielectric spacer includes a first bottom prepreg layer disposed on an opposite side of the first bottom metal layer than the central core layer, a second bottom prepreg layer disposed on the second bottom metal layer, and a first bottom core layer disposed between the first bottom prepreg layer and the second bottom prepreg layer. The second bottom dielectric spacer may include a second bottom core layer disposed on an opposite side of the second bottom metal layer than the second bottom prepreg layer, and a third bottom prepreg layer disposed between the second bottom core layer and the radio frequency manifold layer. The first top dielectric spacer may include a first top prepreg layer disposed on an opposite side of the first top metal layer than the central core layer, a second top prepreg layer disposed on the second top metal layer, and a first top core layer disposed between the first top prepreg layer and the second top prepreg layer. The second top dielectric spacer may include a second top core layer disposed on an opposite side of the second top metal layer than the second top prepreg layer and a third top prepreg layer disposed on an opposite side of the second top core layer at the top end of the antenna board stack.

In some examples, the thicknesses of the first bottom core layer, the first top core layer, and the central core layer are substantially equal. The thicknesses of the second bottom core layer and the second top core layer may be substantially equal. The thicknesses of the first and second bottom prepreg layers and the first and second top prepreg layers may be substantially equal, and the thicknesses of the third bottom prepreg layer and the third top prepreg layer may be substantially equal.

The radio frequency manifold layer may include a passive splitter/combiner formed by a conductive micro-strip line formed on the third bottom prepreg layer. The antenna assembly may further include a control routing conductive layer disposed between the second bottom core layer and the third bottom prepreg layer. The control routing conductive layer may be connected to the radio frequency manifold layer by a first controlled-depth via formed through the third bottom prepreg layer. The radio frequency manifold layer may be connected to the second bottom metal layer by a second controlled-depth via formed through the third bottom prepreg layer, the control routing conductive layer, and the second bottom core layer.

In some examples, one or more support members extend from the interior surface of the casing and into contact with the bottom end of the antenna board stack to define a bottom air-gap between the casing and the bottom end of the antenna board stack. In some examples, the radome is formed from one or more plastic materials, and the outer surface of the radome may be coated with a hydrophobic material. The radome and the top end of the printed circuit board may be separated by a top air-grip.

The radome may include one or more support members extending from the inner surface configured to support the radome upon the top end of the antenna board stack and define the top air-gap separating the radome and the top end of the antenna board stack. The outer surface of the radome may be curved to facilitate water and snow run-off. The radome and the antenna board stack may be sloped relative to the inner and ground-engaging surfaces of the casing to facilitate water and snow run-off. The antenna board stack may be rotated about a center axis by an amount corresponding to the slope of the antenna board stack to place a grating lobe furthest away at a widest scan angle of the antenna board stack.

Another aspect of the disclosure provides a second phased-array antenna. The antenna includes a central core layer of a stacked printed circuit board, a bottom portion of the stacked printed circuit board and a top portion of the stacked printed circuit board. The central core layer includes a bottom surface and a top surface disposed on an opposite side of the central core layer than the bottom surface. The bottom portion defines a bottom thickness extending between the bottom surface of the central core layer and a bottom end of the stacked printed circuit board. The bottom portion includes a first antenna layer in opposed contact with the bottom surface of the central core layer and a ground plane layer spaced apart from the first antenna layer. The top portion defines a top thickness extending between the top surface of the central core layer and a top end of the stacked printed circuit board. The top portion includes a second antenna layer in opposed contact with the top surface of the central core layer and a third antenna layer spaced apart from the second antenna layer and separated from the top surface of the central core layer by a distance substantially equal to a distance the ground plane layer is separated from the bottom surface of the central core layer. The top thickness defined by the top portion of the stacked printed circuit board and the bottom thickness defined by the bottom portion of the stacked printed circuit board are substantially equal.

This aspect may include one or more of the following optional features. The first, second, and third antenna layers may each include an associated metal patch pattern. At least one of the metal patch patterns associated with the first, second, or third antenna layers may be different. One or more cross-dipoles may be placed electrically between metal patches of at least one of the antenna layers to produce electric field lines in a first direction and a second direction orthogonal to the first direction.

The antenna may include a first bottom dielectric layer separating the first antenna layer and the ground plane layer, a radio frequency manifold layer disposed at the bottom end of the stacked printed circuit board, a second bottom dielectric layer separating the radio frequency manifold layer and the ground plane layer, a first top dielectric layer separating the second antenna layer and the third antenna layer, and a second top dielectric layer disposed at the top end of the stacked printed circuit board. The first top dielectric layer and the first bottom dielectric layer may include a dielectric thickness different than the dielectric thickness of the second top dielectric layer and the second bottom dielectric layer. The first bottom dielectric layer, the first top dielectric layer, the second bottom dielectric layer, and the second top dielectric layer may be formed from printed circuit board materials.

In some examples, the radio frequency manifold layer, the ground plane layer, the first antenna layer, the second antenna layer, and the third antenna layer are connected by at least one probe feed via extending between the top and bottom ends of the stacked printed circuit board. The radio frequency manifold layer and the ground plane layer may be further connected by a first controlled-depth via formed through the second bottom dielectric layer.

In some implementations, the antenna includes a control routing conductive layer formed within the second bottom dielectric layer and connected to the radio frequency manifold layer by a second controlled-depth via formed through a portion of the second bottom dielectric layer between the control routing conductive layer and the radio frequency manifold layer. At least one of the control routing conductive layer or the radio frequency manifold layer may be formed by a conductive micro-strip line printed on the second bottom dielectric layer.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Figure 1A:
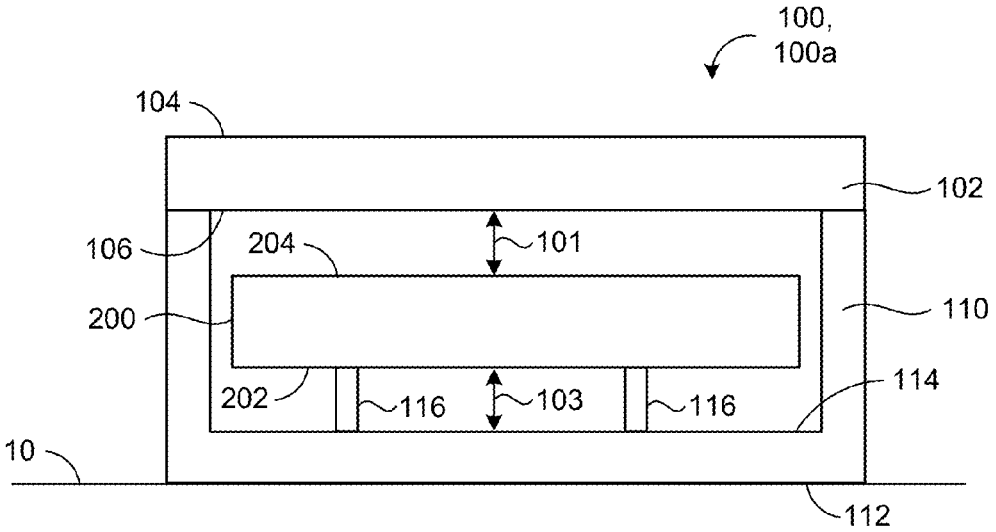
FIG. 1A is a schematic view of an example phased-array antenna assembly including a radome covering an antenna board stack and having a substantially flat outer surface.

Referring to FIGS. 1A-1F, in some implementations, a phased-array antenna assembly 100, 100*a-d* includes an antenna board stack 200, a radome 102 covering the antenna board stack 200, and a casing 110 supporting the antenna board stack 200 above a ground surface 10. The antenna board stack 200 includes a phased-array antenna implemented on a multilayer printed circuit board (PCB) stack. The antenna board stack 200 may include a top end 204 opposing the radome 102 and a bottom end 202 opposing the casing 110. The antenna board stack 200 may define a thickness extending between the top end 204 and the bottom end 202. In some implementations, the antenna board stack 200 is a steerable active electronically scanned array (AESA) antenna including three spaced apart antennas 300, 300*a-c* (FIG. 2) to achieve desirable antenna directivity at a given frequency. In some examples, the antenna board stack 200 allows for arbitrary dual polarization with wide fractional bandwidth (e.g., greater than 20 percent) and wide scan performance (e.g., +/−45 degrees). In some examples, a radio frequency (RF) manifold layer 218 (FIG. 2) is disposed at the bottom end 202 of the antenna board stack 200. The antenna board stack may include active phase shifter circuitry using low cost integrated circuits. In some configurations, the antenna board stack 200 may use multi-chip modules with a passive network to combine outputs of each chip module in a receive mode or split a common input to drive each chip module in a transmit mode (i.e., the RF manifold). The antenna board stack 200, or a separate daughter board (not shown) in communication with the antenna board stack, may include power management features, phase and gain control for each antenna 300, RF up and down conversion, a modem, and/or other digital communications hardware.

The casing 110 may include an interior surface 114 opposing the bottom end 202 of the antenna board stack 200 and a ground-engaging surface 112 disposed on an opposite side of the casing 110 than the interior surface 114. The casing 110 may protect exposed surfaces of the antenna board stack 200 not covered by the radome 102 from weather elements such as rain, snow, and/or debris-build up. A low cost lossy dielectric material may be attached to the casing 110 to suppress microstrip cavity resonances. In some implementations, the casing 110 includes one or more support members 116 (e.g., feet) extending from the interior surface 114 and into contact with the bottom end 202 of the antenna board stack 200 to support the antenna board stack 200 above the ground 10 and define a bottom air gap 103 therebetween. The bottom air gap 103, in conjunction with a lossy material and metal enclosure, may suppress resonance between the bottom end 202 of the antenna board stack 200 and the overall casing 110. For example, the bottom air gap 103 may suppress resonance between the RF manifold layer 218 disposed at the bottom end 202 of the antenna board stack 200 and the casing 110 that would otherwise negatively impact RF performance of the antenna board stack 200. More specifically, the lossy dielectric layer suppressing microstrip cavity resonances allows a lost cost microstrip manifold to be used, instead of a high cost stripline manifold. High cost stripline manifolds generally require multi-lamination, unbalanced printed circuit boards.

The antenna board stack 200 may be used outdoors and the radome 102 may protect the antenna board stack 200 from the weather elements such as rain, snow, and/or debris-build up. The antenna board stack 200 may include an outer surface 104 and an inner surface 106 disposed on an opposite side of the radome 102 than the outer surface 104 and opposing the top end 204 of the antenna board stack 200. In some implementations, the radome 102 is co-designed with the antenna board stack 200 to achieve desirable antenna directivity at a desired fractional bandwidth. Accordingly, the radome 102 may be integrated with the antenna board stack 200 and formed from one or more low-cost plastics such as polystyrene without the need to use expensive multilayer radomes such as a C sandwich radome. The antenna board stack 200 may be a balanced antenna board stack 200 where the radome 102 is configured to protect radiating elements of the balanced printed board stack 200. The combination of the radome 102 and radiating element(s) of the antenna board stack 200 results in the phased-array antenna assembly 100 having a relatively wide scan volume and frequency bandwidth.

Figure 1B:
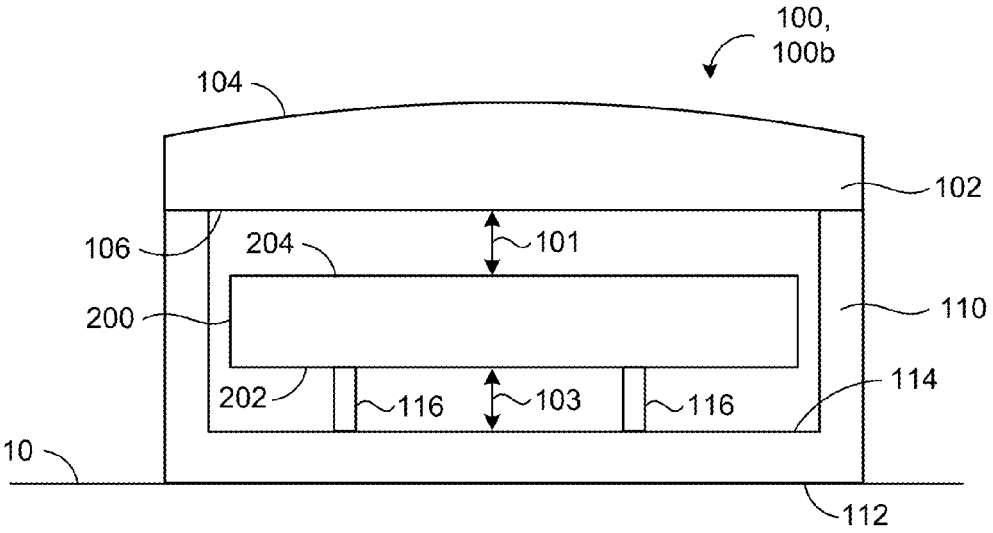
FIG. 1B is a schematic view of an example phased-array antenna assembly including a radome covering an antenna board stack and having a curved outer surface.
Figure 1C:
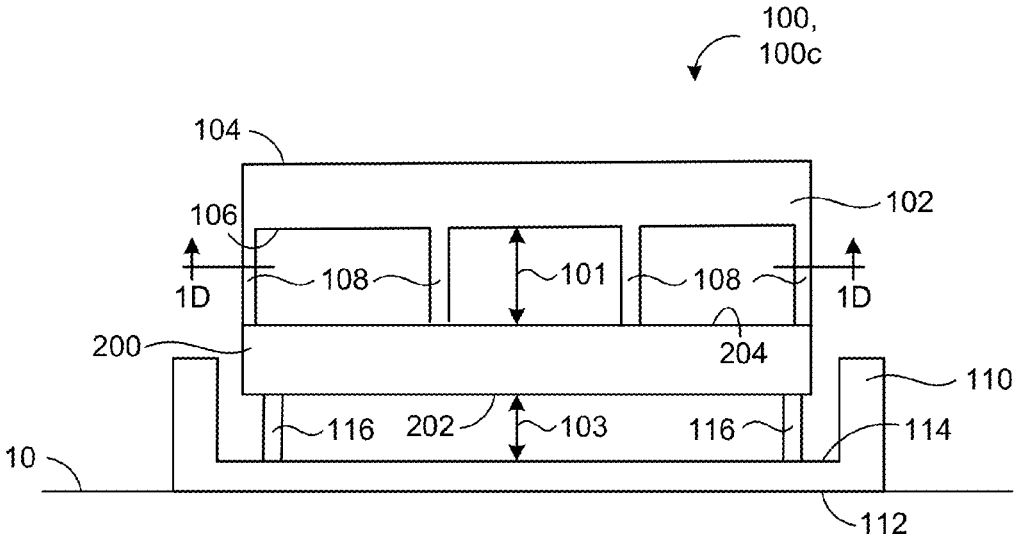
FIG. 1C is a schematic view of an example phased-array antenna assembly including a radome covering an antenna board stack and including a plurality of support members defining an air gap between the radome and the antenna board stack.
Figure 1D:
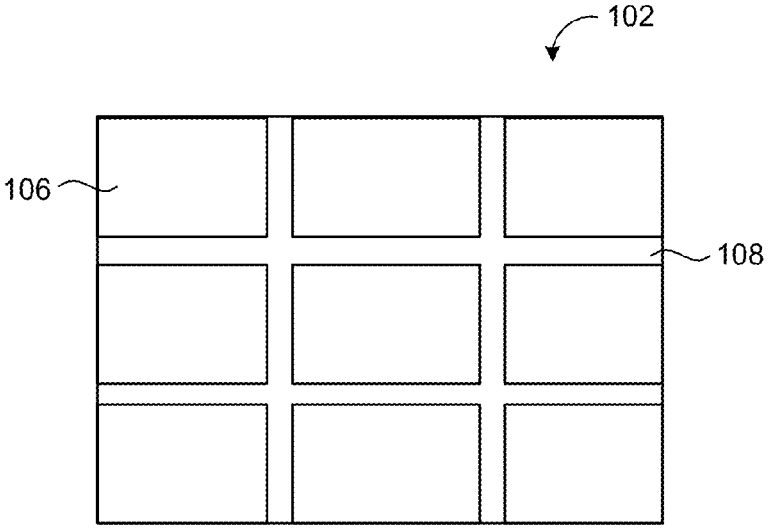
FIG. 1D is a cross-sectional view taken along line 1D-1D of FIG. 1C showing an example pattern defining the plurality of support members and a non-uniform inner surface.
Figure 1E:
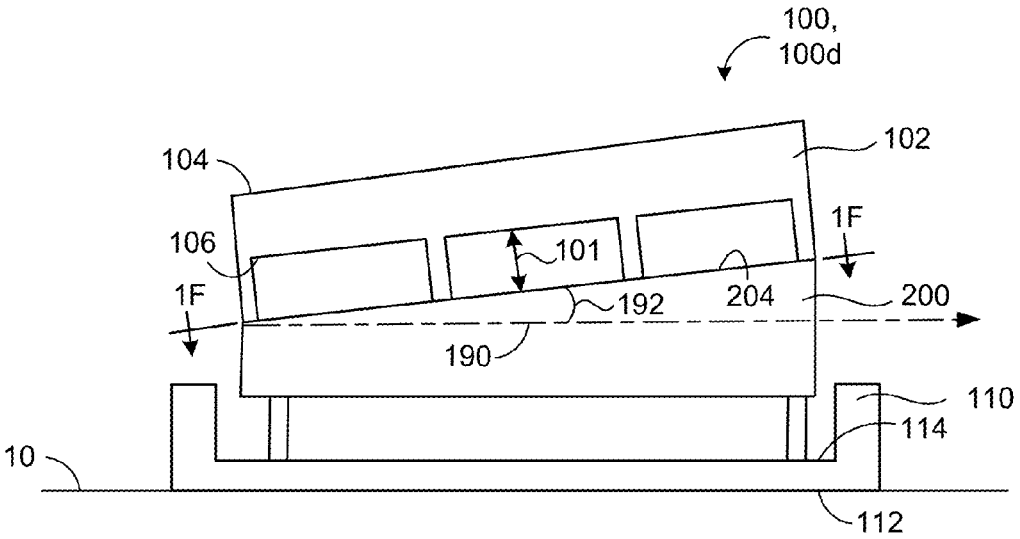
FIG. 1E is a schematic view of an example phased-array antenna assembly including a radome covering an antenna board stack with the radome and the antenna board stack sloped relative to a ground surface.

In some implementations, a top air gap 101 is defined between the inner surface 106 of the radome 102 and the top end 204 of the antenna board stack 200 to allow for impedance control of the antenna across all scan angles. Referring to FIGS. 1A and 1B, in some examples, the casing 110 supports the radome 102 over the top end 204 of the antenna board stack 200 with the top air gap 101 separating the top end 204 and the inner surface 106. In other examples, FIGS. 1C and 1E show one or more support members 108 extending from the inner surface 106 of the radome 102 to support the radome 102 upon the top end 204 of the antenna board stack 200 and define the top air gap 101 separating the top end 204 and the inner surface 106. The support members 108 may be integrally formed with the radome 102. For example, FIG. 1D is a cross-sectional view taken along line 1D-1D of FIG. 1C showing a plurality of recesses formed in a pattern through the inner surface 106 of the radome 102 to define the support members 108. The recesses provide non-uniformity to the inner surface 106 of the radome 102 and the pattern of the recesses may be selected for use with the antenna board stack 200 to provide desirable antenna RF performance.

Figure 1F:
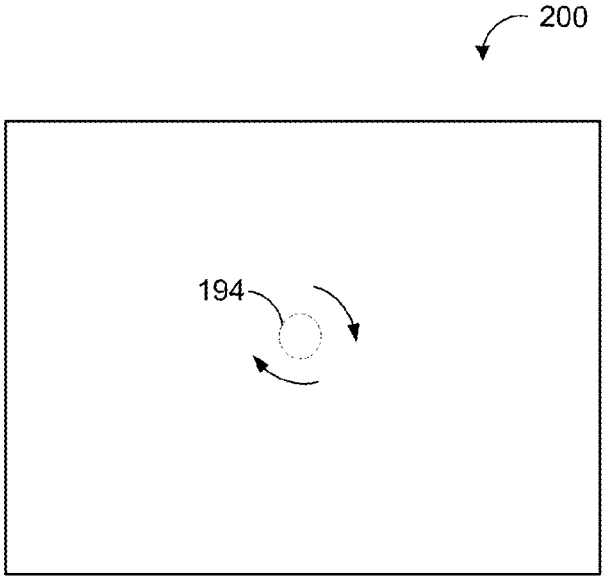
FIG. 1F is a cross-sectional view taken along line 1F-1F of FIG. 1E showing the antenna board stack rotated about a center axis by an amount corresponding to the slope of the antenna board stack relative to the ground surface.

Referring to FIGS. 1A and 1C, in some implementations, the outer surface 104 of the radome 102 may be substantially flat and coplanar with the ground surface 10. The flat outer surface 104, however, may permit water and/or snow to build up, and thereby adversely impact the RF performance of the antenna board stack 200. To prevent water and/or snow from building up, the outer surface 104 may be coated with a hydrophobic coating when the radome 102 is formed from plastics (e.g., polystyrene). Referring to FIG. 1B, in other implementations, the outer surface 104 of the radome 102 may be curved to facilitate water and/or snow run-off. Referring to FIG. 1E, in some implementations, the radome 102 and the top end 204 of the antenna board stack 200 are sloped relative to the interior surface 114 and the ground-engaging surface 112 of the casing 110 to facilitate water and/or snow run-off from the outer surface 104 of the radome 102 and/or the top end 204 of the antenna board stack 200. FIG. 1E shows the slope 192 of the radome 102 and the top end 204 of the antenna board stack 200 with respect to a longitudinal line 190 extending substantially parallel with the ground surface 10. In these implementations, the antenna board stack 200 may include a wedge shape and the top air gap 101 may be substantially constant between the inner surface 106 of the radome 102 and the top end 204 of the antenna board stack 200. While sloping the radome and the antenna board stack 200 may prevent the weather elements from collecting upon the top end 204 of the antenna board stack 200 and the outer surface 104 of the radome 102, the degree of the slope 192 consequently requires a larger scan angle by the antenna board stack 200 in the direction of the slope 192 and by an amount of the slope 192 to meet scan requirements. To compensate for the larger scan angle required by the amount of the slope 192 of the antenna board stack 200, the antenna board stack 200 may be aligned so that a grating lobe radiated by the antenna board stack 200 occurs at the widest scan angle. FIG. 1F is a cross-sectional view taken along line 1F-1F of FIG. 1E showing the antenna board stack 200 rotated (e.g. clockwise) about a central axis 194 of the antenna board stack 200. Here, the antenna board stack 200 may be rotated about the center axis 194 by an amount corresponding to 45 degrees with respect to the slope 192 of the antenna board stack 200 to place the grating lobe at the widest scan angle. Rotating the antenna board stack 200 by 45 degrees with respect to the direction of the slope 192, places the grating lobe as far away as possible in the direction of the slope 192 to allow for extra scan in that direction to compensate for the slope of the antenna board stack 200 and the radome 102.

Figure 2:
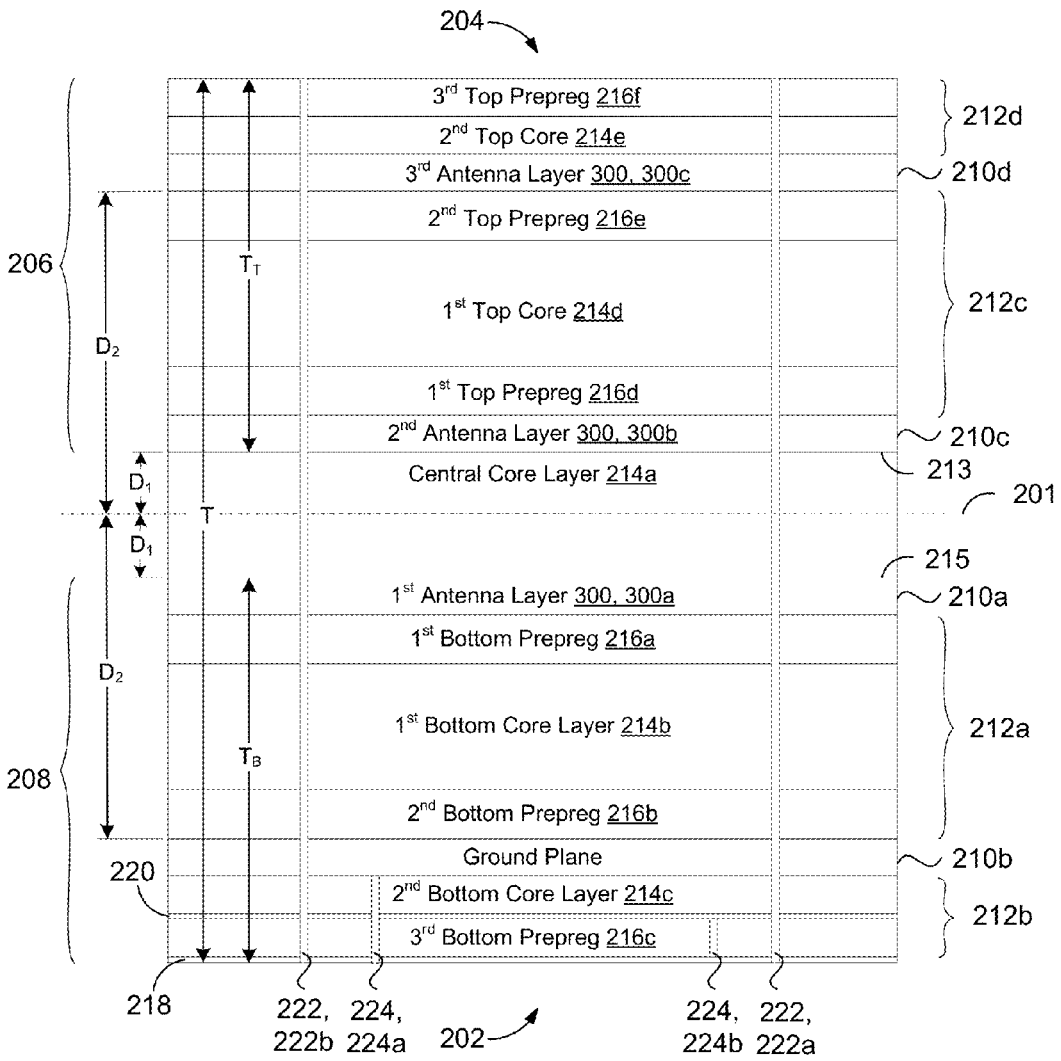
FIG. 2 is a schematic view of an example antenna board stack implementing a phased-array antenna.

Referring to FIG. 2, in some implementations, the antenna board stack 200 includes a bottom multilayer antenna unit 208 (hereinafter 'bottom portion 208'), a top multilayer antenna unit 206 (hereinafter 'top portion 206'), and a central core layer 214*a* disposed between the bottom portion 208 and the top portion 206. The antenna board stack 200 may define a thickness T between the bottom end 202 and the top end 204. In some implementations, a soldermask layer is applied to the bottom end 202 and the top end 204 of the antenna board stack 200. The soldermask layer at each of the bottom end 202 and the top end 204 may be 0.5 mils (e.g., 0.0005 inches). The central core layer 214*a* may include a bottom surface 215 and a top surface 213 disposed on an opposite side of the central core layer 214*a* than the bottom surface 215. An axis of symmetry 201 may bisect the bottom surface 215 and the top surface 213 of the central core layer 214*a* to divide the thickness T of the antenna board stack 200 in half. The bottom portion 208 of the antenna board stack 200 may define a bottom thickness $T_B$ between the bottom surface 215 of the central core layer 214*a* and the bottom end 202 of the antenna board stack 200. The top portion 206 of the antenna board stack 200 may define a top thickness $T_T$ between the top surface 213 of the central core layer 214*a* and the top end 204 of the antenna board stack. The bottom thickness $T_B$ and the top thickness $T_T$ may be substantially equal and balanced about the central core layer 214*a*, and also balanced about the axis of symmetry 201.

The antenna board stack 200 includes four spaced-apart metal layers 210*a-d* and at least one of the central core layer 214*a* or dielectric spacer layers 212*a-d* in opposed contact with each of the metal layers 210*a-d*. The metal layers 210*a-d* may be formed from conductive metals such as copper. The dielectric spacer layers 212*a-d* may be formed from printed circuit board materials such as flame retardant 4 (FR4) glass epoxy composites and include dielectric constants ranging from about 3.0 to about 5 for desirable antenna performance at frequencies below about 15 GHz. Each dielectric spacer layer 212*a-d* may include one substrate core layer 214*b-e* and at least one pre-impregnated composite fiber layer 216*a-f* (hereinafter 'prepreg layer 216*a-f*').

The metal layers 210*a-d* and the dielectric layers 212*a-d* may be equally balanced about the central core layer 214*a* to prevent warping of the antenna board stack 200. As used herein, equally balancing the metal layers 210*a-d* and the dielectric spacer layers 212*a-d* about the central core layer 214*a* refers to the top portion 206 and the bottom portion 208 of the antenna board stack 200 including an equal number of metal layers 210*a-d* and dielectric spacer layers 212*a-d* with corresponding ones of the metal layers 210*a-d* and dielectric spacer layers 212*a-d* displaced by substantially the same distance from the corresponding one of the top surface 213 or the bottom surface 215 of the central core layer 214*a*. The balanced antenna board stack 200 allows the number of total layers required to achieve desirable antenna directivity at a given frequency to be minimized. Additionally, and as will become more apparent, the balanced antenna board stack 200 eliminates the need for multiple lamination cycles in manufacturing. Thus, balancing the antenna board stack 200 prevents warping and reduces manufacturing costs by reducing the total number of layers and eliminating the need for multiple lamination cycles to manufacture the antenna board stack 200.

The bottom portion 208 of the antenna board stack 200 may include a first bottom metal layer 210*a* in opposed contact with the bottom surface 215 of the central core layer 214*a* and having a first distance $D_1$ from the axis of symmetry 201, and a second bottom metal layer 210*b* spaced apart from the first bottom metal layer 210*a* and having a second distance $D_2$ from the axis of symmetry 201. Similarly, the top portion 206 of the antenna board stack 200 may include a first top metal layer 210*c* in opposed contact with the top surface 213 of the central core layer 214*a* and having the first distance $D_1$ from the axis of symmetry 201, and a second top metal layer 210*d* spaced apart from the first top metal layer 210*c* and having the second distance $D_2$ from the axis of symmetry 201. The thicknesses of the first bottom metal layer 210*a* and the first top metal layer 210*c* may be substantially the same, and the thicknesses of the second bottom metal layer 210*b* and the second top metal layer 210*d* may be substantially the same.

The top portion 206 of the antenna board stack 200 may include two dielectric spacers including a first top dielectric layer 212*c* and a second top dielectric layer 212*d*. The first top dielectric layer 212*c* may be disposed between the first top metal layer 210*c* and the second top metal layer 210*d*. The second top dielectric layer 212*d* may be disposed on an opposite side of second top metal layer 210*d* than the first top dielectric layer 212*c*.

The bottom portion 208 of the antenna board stack 200 may also include two dielectric spacers including a first bottom dielectric layer 212*a* and a second bottom dielectric layer 212*b*. The first bottom dielectric layer 212*a* may be disposed between the first bottom metal layer 210*a* and the second bottom metal layer 210*b*. The first bottom dielectric layer 212*a* may include a thickness substantially equal to a thickness of the first top dielectric layer 212*c* of the top portion 206. The second bottom dielectric layer 212*b* may be disposed between the second bottom metal layer 210*b* and the RF manifold layer 218 disposed at the bottom end 202 of the antenna board stack 200. The second bottom dielectric layer 212*b* may include a thickness substantially equal to a thickness of the second top dielectric layer 212*d* of the top portion 206.

In some implementations, the first bottom dielectric layer 212*a* of the bottom portion 208 includes a first bottom prepreg layer 216*a* disposed an opposite side of the first bottom metal layer 210*a* than the central core layer 214*a*, a second bottom prepreg layer 216*b* disposed on the second bottom metal layer 210*b*, and a first bottom core layer 214*b* disposed between the first bottom prepreg layer 216*a* and the second bottom prepreg layer 216*b*. The second bottom dielectric layer 212*b* of the bottom portion 208 may include a second bottom core layer 214*c* disposed on an opposite side of the second bottom metal layer 210*b* than the second bottom prepreg layer 216, and a third bottom prepreg layer disposed between the second bottom core layer 214*c* and the RF manifold layer 218.

In some examples, the first top dielectric layer 212*c* of the top portion 206 includes a first top prepreg layer 216*d* disposed on an opposite side of first top metal layer 210*c* than the central core layer 214*a*, a second top prepreg layer 216*e* disposed on the second top metal layer 210*d*, and a first top core layer 214*d* disposed between the first top prepreg layer 216*d* and the second top prepreg layer 216*e*. The second top dielectric layer 216*d* of the top portion 206 may include a second top core layer 214*e* disposed on an opposite side of the second top metal layer 210*d* than the second top prepreg layer 216*e*, and a third top prepreg layer 216*f* disposed at the top end 204 of the antenna board stack 200 on an opposite side of the second top core layer 214*e* than the second top metal layer 210*d*.

In some implementations, the thicknesses (e.g. dielectric thicknesses) of the central core layer 214*a*, first bottom core layer 214*b*, and the first top core layer 214*d* are substantially equal, and the thicknesses of the second bottom core layer 214*c* and the second top core layer 214*e* are substantially equal. In some examples, the thicknesses associated with each of the core layers 214*c*, 214*e* is less than the thickness associated with each of the core layers 214*a*, 214*b*, 214*d*. In some implementations, the thicknesses (e.g., dielectric thicknesses) of the first and second bottom prepreg layers 216*a*, 216*b* and the first and second top prepreg layers 216*d*, 216*e* are substantially equal (e.g., about 4.0 mils), and the thicknesses of the third bottom prepreg layer 216*c* and the third top prepreg layer 216*f* are substantially equal and less than the thicknesses of the first and second top prepreg layers 216*d*, 216*e*. In some examples, the thickness associated with each of the prepreg layers 216*c*, 216*f* is less than the thickness associated with each of the prepreg layers 216*a*, 216*b*, 216*d*, 216*e*. As used herein, a "mil" is a unit of length equal to 0.001 of an inch.

The antenna board stack 200 may include all active and passive components disposed proximate to the bottom end 202 of the antenna board stack 200, while the top end 204 faces the direction of antenna radiation. In some implementations, the RF manifold layer 218 is disposed at the bottom end 202 and includes a passive splitter/combiner implemented from microstrip transmission lines formed on the second bottom dielectric layer 212*b*. The RF manifold layer 218 may be built as a reactive network or with Wilkinson splitter/combiners using conventional surface mount resistors. Control and routing for the antenna board stack 200 may also be implemented with the RF manifold layer 218 at the bottom end 202 or a control routing conductive layer 220 disposed between the second bottom core layer 214*c* and the third bottom prepreg layer 216*c* may provide the control and routing. The control routing conductive layer 220 may include a microstrip line formed on the second bottom core layer 214*c* or the third bottom prepreg layer 216*c*. For example, the microstrip line associated with the control routing conductive layer 220 may be printed on the second bottom core layer 214*c* or the third bottom prepreg layer 216*c*. The RF manifold layer 218 and control routing conductive layer 220 are associated with relatively sparse layers of metal. Accordingly, a metal layer corresponding to the control routing conductive layer 220 may be disposed between the second top core layer 214*e* and the third top prepreg layer 216*f* of the top portion 206 and another metal layer corresponding to the RF manifold layer 218 may be disposed at the top end 204 to balance metal density about the central core layer 214*a*. However, FIG. 2 shows these corresponding metal layers removed, e.g., by etching.

In some examples, the antenna board stack 200 includes a balanced printed circuit board stack having three radiating element layers 300, 300*a-c*, a ground plane 210*b*, and the microstrip manifold layer 218. In some implementations, the first bottom metal layer 210*a*, the first top metal layer 210*c*, and the second top metal layer 210*d* each include a corresponding antenna 300, 300*a-c*, and the second bottom metal layer 210*b* includes the ground plane 210*b* shared by each of the antennas 300 and the RF manifold layer 218 disposed at the bottom end 202 of the antenna board stack 200. Accordingly, the antenna board stack 200 does not require the use of multiple ground planes connected through multiple internal vias, thereby allowing the antenna board stack to be manufactured using a single lamination cycle, and thus reducing the cost of manufacturing. In some examples, at least one probe fed via 222, 222*a-b* extends between the bottom end 202 and the top end 204 of the antenna board stack 200, and connect each antenna 300*a-c*, the RF manifold layer 218, and the ground plane 210*b* together for distributing RF signals. The probe fed vias 222 may be formed by drilling a hole through antenna board stack and filling the hole with metal. Epoxy resins may also optionally fill the probe fed vias 222. Via stubs at the top end 204 of the antenna board structure may be back-drilled or left in place based upon the antenna RF requirements.

In some examples, the RF manifold layer 218 connects to the control routing conductive layer 220 and the ground plane layer 210*b* using controlled-depth vias 224, 224*a-b*. For example, a first controlled-depth via 224*a* may be formed through the second bottom dielectric layer 212*b* between the radio frequency manifold layer 218 and the ground plane layer 210*b* to connect the radio frequency manifold layer 218 to the ground plane 210*b*. Specifically, the first controlled-depth via 224*a* may be formed through the third bottom prepreg layer 216*c*, the control routing conductive layer 220, and the second bottom core layer 214*c*. A second controlled-depth via 224*b* may also be formed through the third bottom prepreg layer 216*c* between the radio frequency manifold layer 218 and the control routing conductive layer 220 to connect the radio frequency manifold layer 218 to the control routing conductive layer 220. The third bottom prepreg layer 216*c* and the second bottom core layer 214*c* having small dielectric thicknesses allows the first controlled-depth vias 224*a* to include a diameter of about 1.25 times the combined dielectric thickness of the third bottom prepreg layer 216*c* and the second bottom core layer 214*c*. The second controlled-depth via 224*b* may include a diameter of about 1.25 times the dielectric thickness of the third bottom prepreg layer 216*c*. The controlled-depth vias 224 may be drilled with a laser and optionally filled with metal to provide a standard high density interconnect approach.

The antennas 300 associated with the first bottom metal layer 210*a* (e.g., first antenna layer 300*a*), the first top metal layer 210*c* (e.g., second antenna layer 300*b*), and the second top metal layer 210*d* (e.g., third antenna layer 300*c*) provide the phased-array antenna that may be tuned with the radome 102 to provide wide scan performance (e.g., +/−45 degrees) and wide fractional bandwidth (e.g., greater than 20 percent) with arbitrary dual polarization. In some implementations, the antenna layers 300 include slotted antenna apertures. The first antenna layer 300*a* includes a corresponding first metal pattern that may be formed on the bottom surface 215 of the central core layer 214*a* or the first bottom dielectric layer 212*a*. The second antenna layer 300*b* includes a corresponding second metal pattern that may be formed on the top surface 213 of the central core layer 214*a* or the first top dielectric layer 212*c*. The third antenna layer 300*c* includes a corresponding third metal pattern that may be formed on the second top core layer 214*e* or on an opposite side of the first top dielectric layer 212*c* than the second antenna layer 300*b*. At least one of the antenna layers 300 may be associated with a different metal pattern Referring to FIGS. 3A-3C, in some implementations, each antenna layer 300*a-c* includes a different corresponding metal pattern defined by slots 302*a-c* formed through the associated metal layer 210*a*, 210*c*, 210*d*. The metal patterns associated with each of the antennas 300 may cooperate to provide higher-order floquet-mode scattering for the phased-array antenna implemented on the antenna board stack 200. The slots 302*a-c* may be formed by etching and/or cutting to define the metal patterns. The metal layers 210*a*, 210*c*, 210*d* associated with the antennas 300 may include substantially square and planar metal plates. For instance, the metal plates may be formed from conductive metals such as copper. In some examples, each metal layer 210*a*, 310*c*, 210*d* includes a square plate including a length of up to one half wavelength on each side.

Figure 3A:
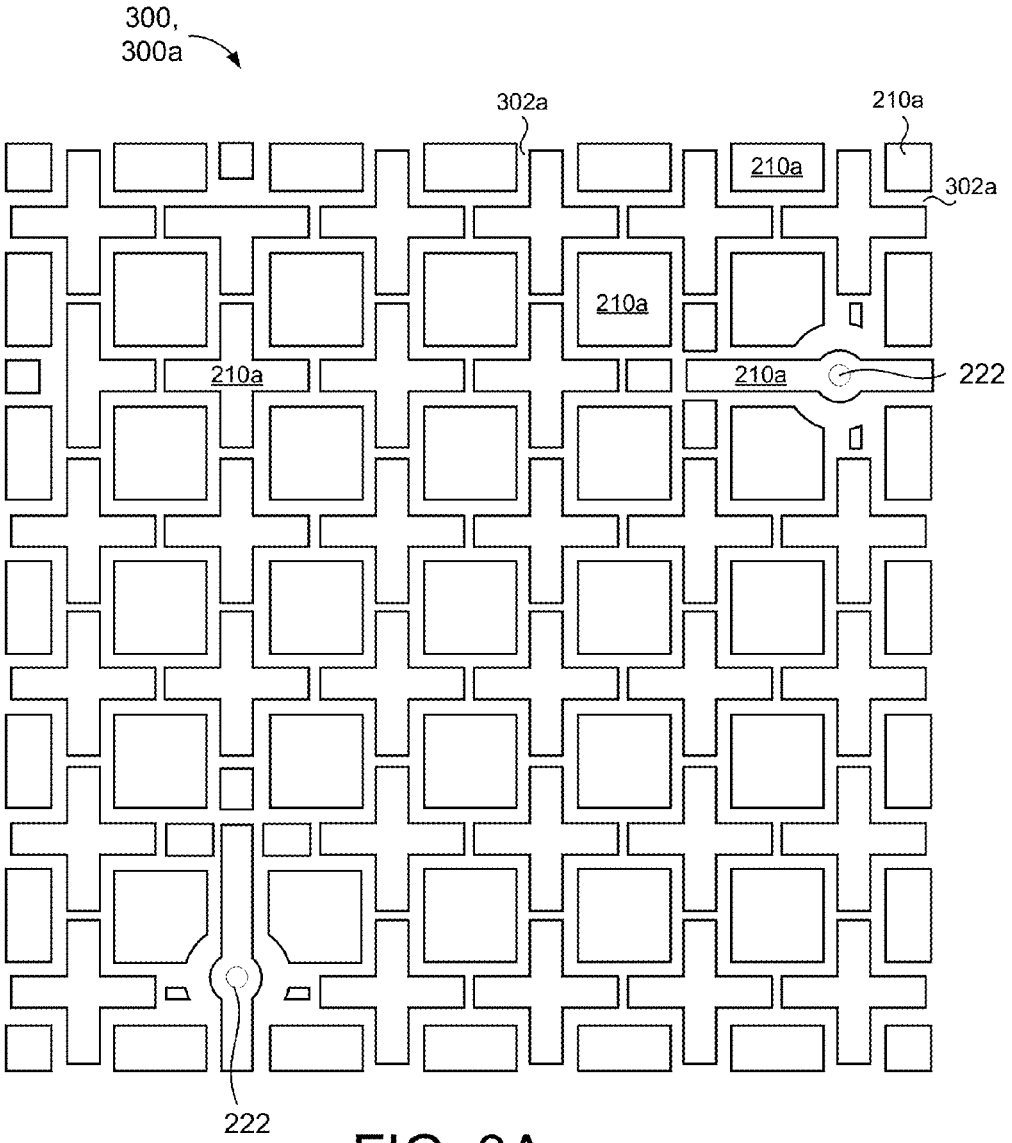
FIG. 3A is a schematic view of a first antenna layer of the antenna board stack of FIG. 2.

FIG. 3A shows the first antenna 300*a* associated with the first metal pattern defined by a first series of slots 302*a* formed through the first bottom metal layer 210*a*. Thus, the first metal pattern is associated with a plurality of metal patches of the first bottom metal layer 210*a* separated by the first series of slots 302*a* formed therethrough. The first series of slots 302*a* may extend both vertically and horizontally to define the first metal pattern for the first antenna 300*a* to enable dual polarization. FIG. 3A shows the probe feed vias 222 formed through associated ones of orthogonal metal patches of the first bottom metal layer 210*a*.

Figure 3B:
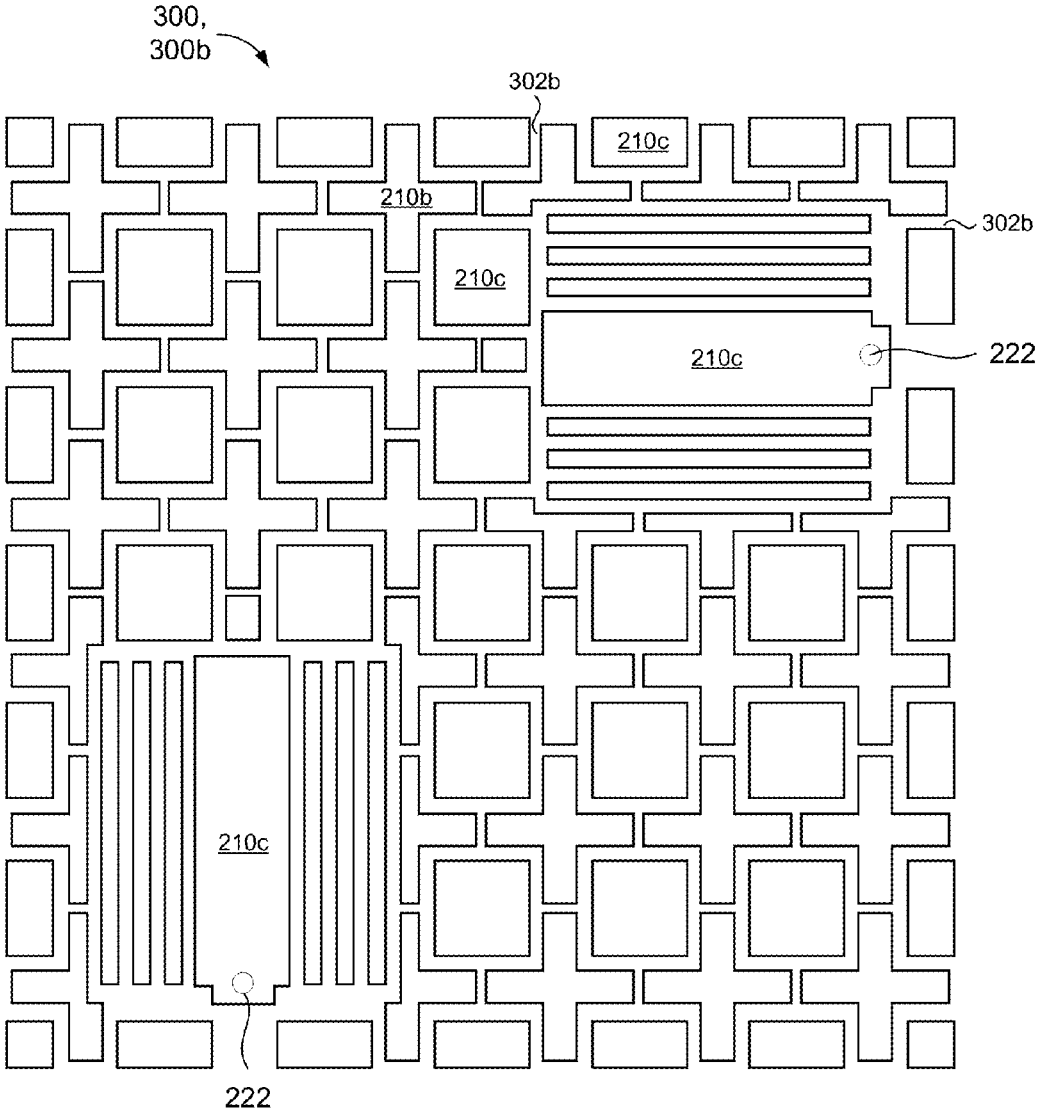
FIG. 3B is a schematic view of a second antenna layer of the antenna board stack of FIG. 2.

FIG. 3B shows the second antenna 300*b* associated with the second metal pattern defined by a second series of slots 302*b* formed through the first top metal layer 210*c*. As with the first metal pattern of the first antenna 300*a* of FIG. 3A, the second metal pattern is associated with a plurality of metal patches of the first top metal layer 210*c* separated by the second series of slots 302*b* formed therethrough. FIG. 3B shows the second series of slots 302*b* extending both vertically and horizontally to define the second metal pattern for the second antenna 300*b* to enable dual polarization. The probe feed vias 222 may be formed through associated ones of orthogonal metal patches of the first top metal layer 210*c*.

Figure 3C:
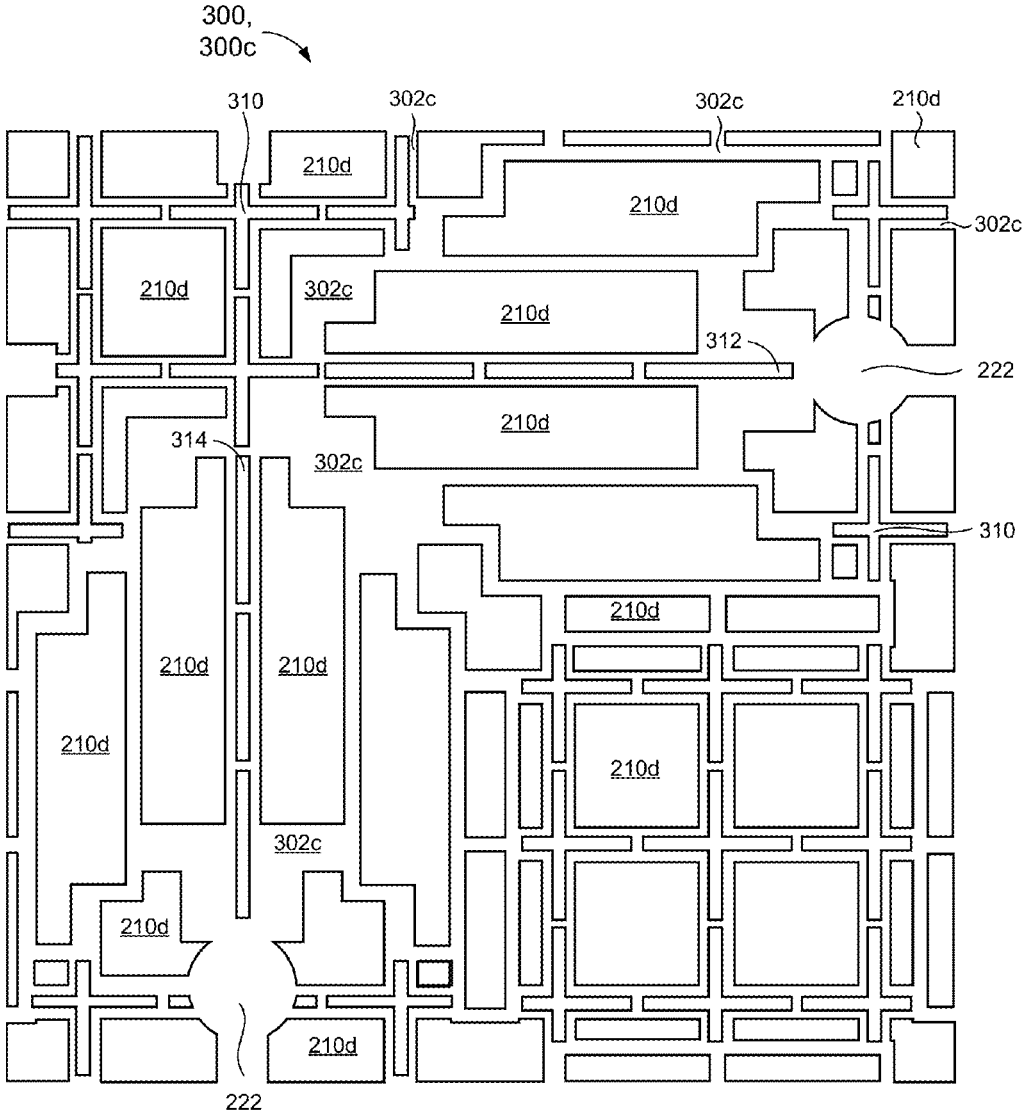
FIG. 3C is a schematic view of a third antenna layer of the antenna board stack of FIG. 2.

FIG. 3C shows the third antenna 300*c* associated with the third metal pattern defined by a third series of slots 302*c* formed through the second top metal layer 210*d*. As with the first metal pattern of the first antenna 300*a* of FIG. 3A and the second metal pattern of the second antenna 300*b* of FIG. 3B, the third metal pattern is associated with a plurality of metal patches of the second top metal layer 210*d* separated by the second series of slots 302*b* formed therethrough. FIG. 3C shows the third series of slots 302*c* extending both vertically and horizontally to define the third metal pattern for the third antenna 300*c* to enable dual polarization. In some implementations, at least one of cross dipoles 310, horizontal dipoles 312, or vertical dipoles 314 may be disposed within the third series of slots 302*c* between the metal patches of the second top metal layer 210*d*. The dipoles 310, 312, 314 may create electric fields indicative of higher-order floquent modes. In some examples, metal patches are instead formed and include shapes associated with corresponding ones of the dipoles 310, 312, 314. The probe feed vias 222 may be formed through associated ones of orthogonal metal patches of the second top metal layer 210*d*.

Figure 4B:
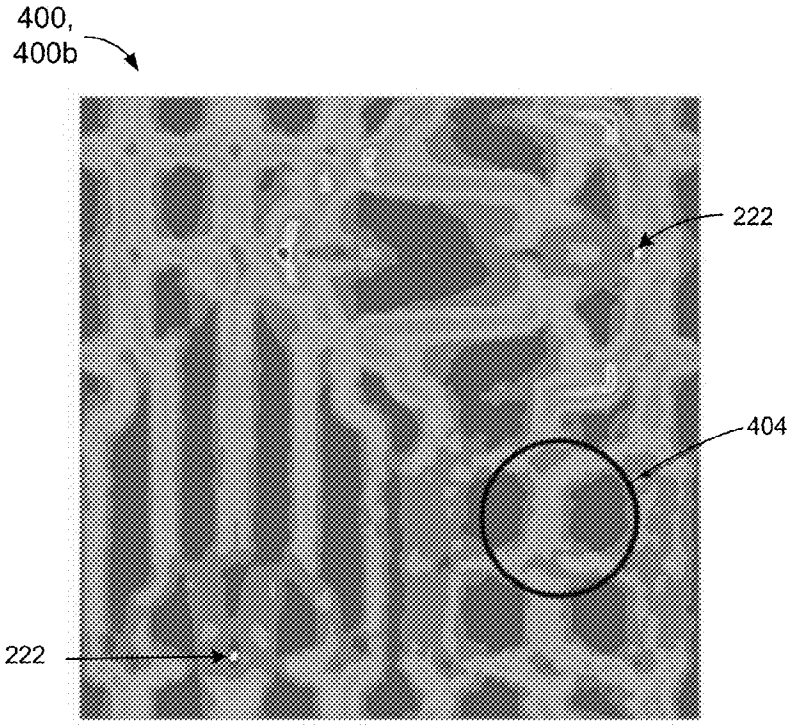
FIG. 4B shows an electric field pattern simulated above the third antenna layer of FIG. 3C.
Figure 4A:
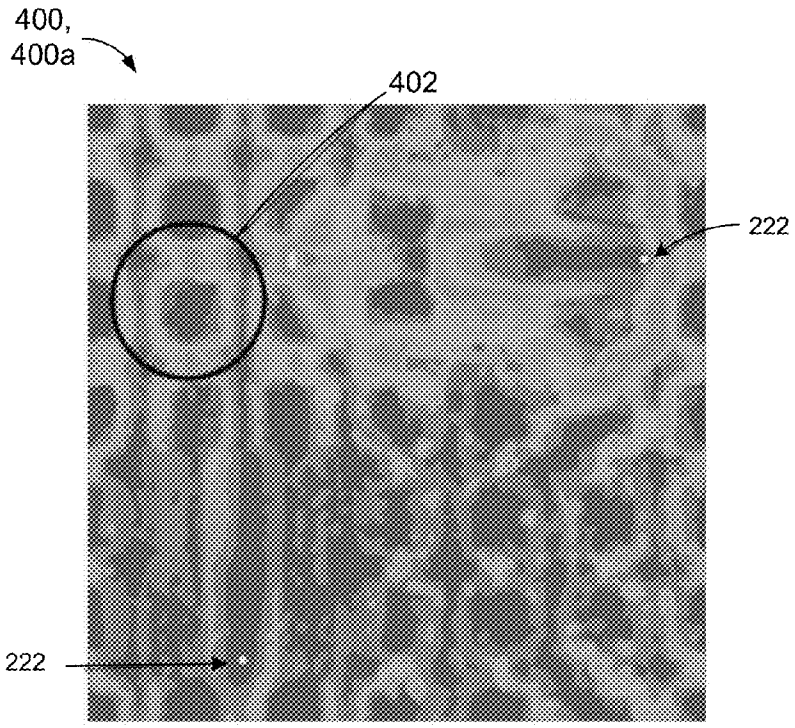
FIG. 4A shows an electric field pattern simulated above the second antenna layer of FIG. 3B.

FIGS. 4A and 4B show electric field patterns 400, 400*a-b* simulated above respective ones of the second antenna layer 300*b* and the third antenna layer 300*c* each providing higher order floquent mode scattering as well as electric fields around the probe feed vias 222. FIG. 4A shows a first electric field pattern 400*a* simulated 0.004 inches above the second antenna layer 300*b*. The electric field lines within area 402 indicate the higher order floquent mode scattering provided by the second metal pattern (FIG. 3B) associated with the second antenna layer 300*b*. FIG. 4B shows a second electric field pattern 400*b* simulated 0.004 inches above the third antenna layer 300*c*. The electric field lines within area 404 indicate the higher order floquent mode scattering provided by the third metal pattern (FIG. 3C) associated with the third antenna layer 300*c*.

Figure 5B:
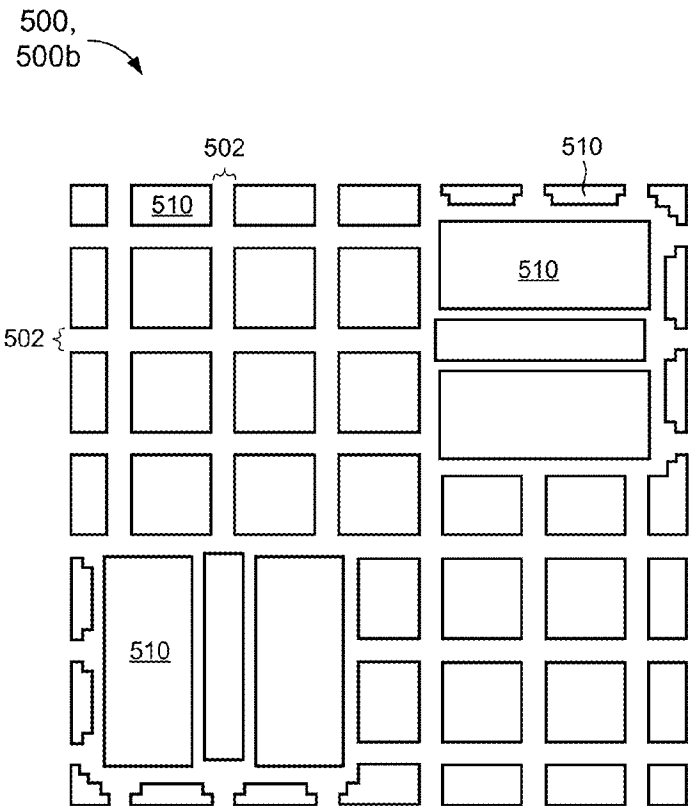
FIG. 5B shows an example metal pattern for an antenna without cross-dipoles disposed electrically between small metal patches defined by the metal pattern.
Figure 5A:
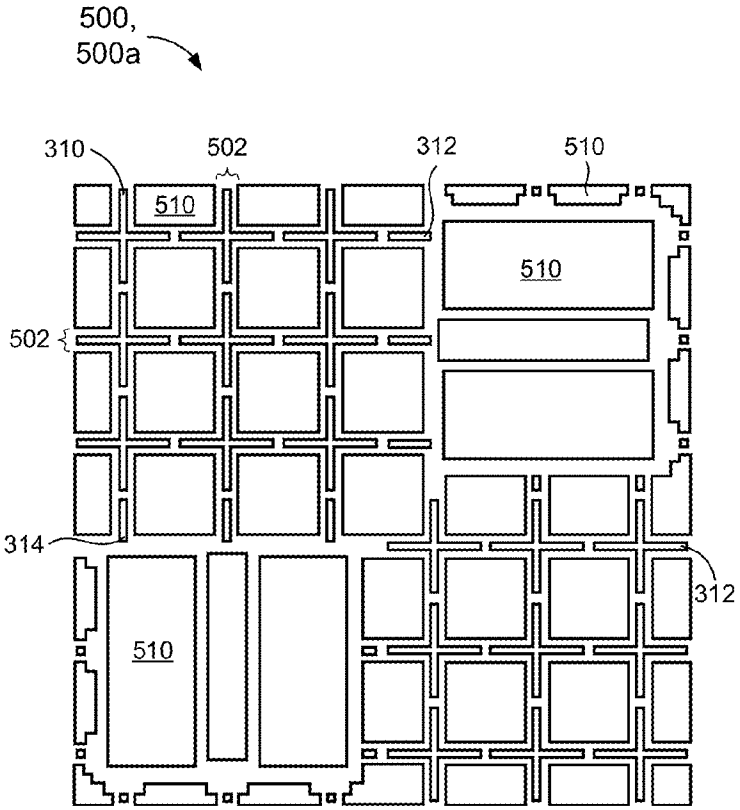
FIG. 5A shows an example metal pattern for an antenna having cross-dipoles disposed electrically between small metal patches defined by the metal pattern.

FIGS. 5A and 5B show example antennas 500, 500*a-b* each including an identical metal pattern defined by a series of slots 502 formed through a metal layer 510. The antenna 500*a* of FIG. 5A includes the cross dipoles 310 disposed within the slots 502 between electrically small metal patches of the metal layer 510. The antenna 500*b* of FIG. 5B, however, does not include the cross dipoles 510.

Figures 6A, 6B:
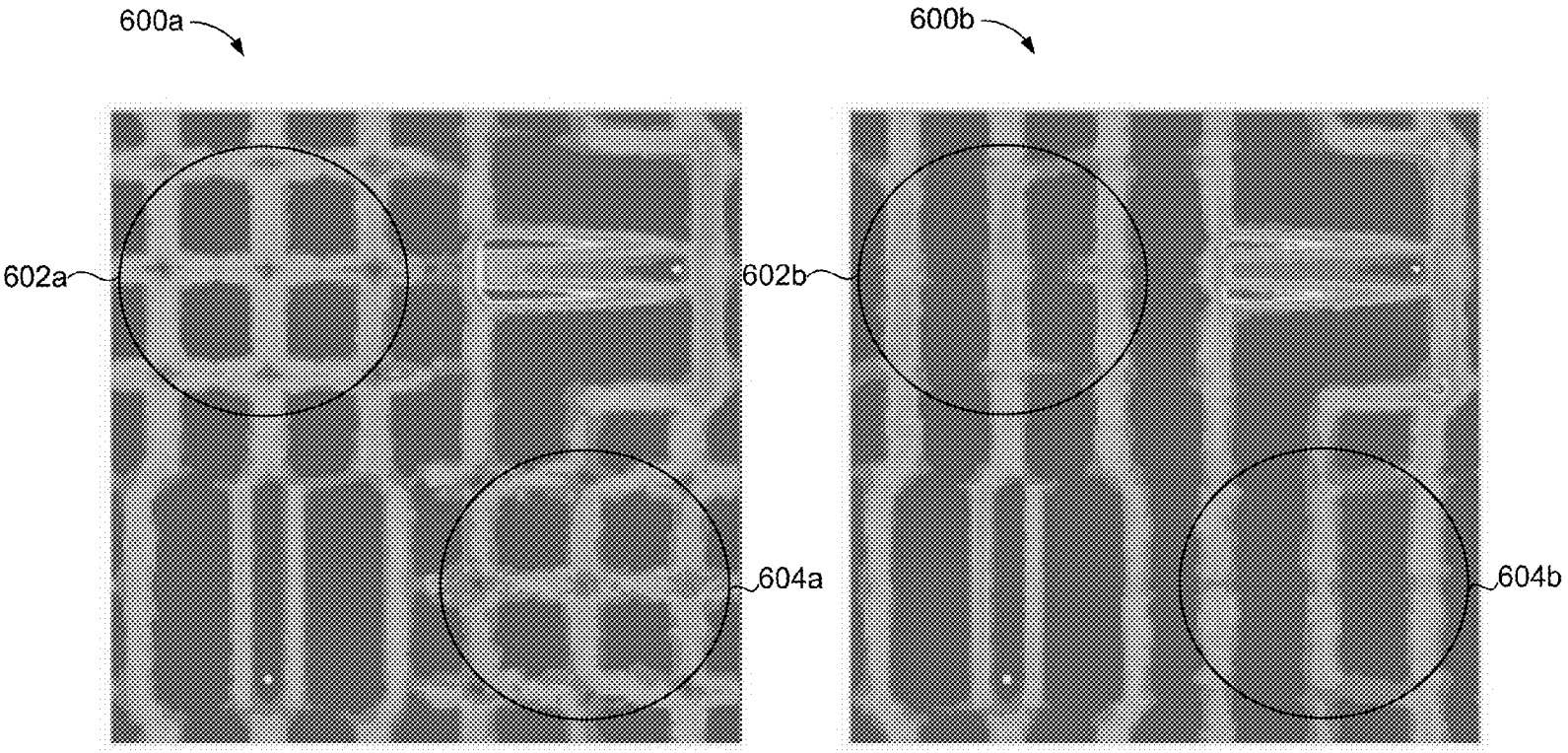
FIG. 6A shows an electric field pattern including electric field lines in a horizontal direction and a vertical direction for the antenna of FIG. 5A.
FIG. 6B shows an electric field pattern including electric field lines only in one direction for the antenna of FIG. 6A.

Referring to FIGS. 6A and 6B, electric field patterns 600, 600*a-b* simulated above respective ones of the antennas 500 of FIGS. 5A and 5B show the antenna 500*a* including the cross dipoles 510 provides a higher-order floquent mode scattering than the antenna 500*b* without the cross dipoles. For example, the electric field pattern 600*a* of FIG. 6A shows the cross dipoles 510 of the antenna 500*a* creating electric field lines in both a horizontal direction and a vertical direction within areas 602*a* and 604*a*. By contrast, the electric field pattern 600*b* of FIG. 6B shows the antenna 500*b* associated with the same metal pattern but without the cross dipoles only creating electric field lines in one direction within areas 602*b*, 604*b* (e.g., the vertical direction relative to the view of FIG. 6B). In some implementations, by incorporating the cross dipoles 510 between the metal patches of the metal layer 510 to create the electric field pattern 600*a* with orthogonal electric field lines (e.g., electric field lines in both the horizontal and vertical directions), the antenna 500*a* provides floquent modes that are more evanescent, and therefore higher-order, than the floquent modes associated with the antenna 500*b* without the cross dipoles. Additionally, the increased evanescence of the floquent mode desirably reduces variability over scan and frequency of the antenna 500*a*.

A number of implementations have been described. Nevertheless, it will be understood that various modifications may be made without departing from the spirit and scope of the disclosure. Accordingly, other implementations are within the scope of the following claims.

What is claimed is:

1. A phased-array antenna assembly, comprising:

an antenna board stack defining a thickness between a bottom end and a top end, the antenna board stack comprising:

a central core layer including a bottom surface and a top surface disposed on an opposite side of the central core layer than the bottom surface, and defining an axis of symmetry bisecting the bottom surface and the top surface to divide the thickness of the antenna board stack in half;

a bottom multilayer antenna unit defining a bottom thickness between the bottom surface of the central core layer and the bottom end of the antenna board stack, the bottom multilayer antenna unit comprising a first bottom metal layer in opposed direct contact with the bottom surface of the central core layer and a second bottom metal layer spaced apart from both the first bottom metal layer and the bottom end of the antenna board stack, the first and second bottom metal layers each associated with a different distance from the axis of symmetry; and a top multilayer antenna unit defining a top thickness between the top surface of the central core layer and the top end of the antenna board stack that is substantially equal to the bottom thickness of the bottom multilayer antenna unit, the top multilayer antenna unit comprising two spaced apart top metal layers each associated with a corresponding one of the distances from the axis of symmetry associated with the bottom metal layers;

a radome configured to cover the top end of the antenna board stack, the radome including an outer surface and an inner surface disposed on an opposite side of the radome than the outer surface and opposing the top end of the antenna board stack; and a casing configured to support the antenna board stack above a ground surface, the casing including an interior surface opposing the bottom end of the antenna board stack and a ground-engaging surface disposed on an opposite side of the casing than the interior surface.

2. The antenna assembly of claim 1, wherein:

the first multilayer antenna unit comprises:

a first bottom dielectric spacer disposed between the first bottom metal layer and the second bottom metal layer;

a radio frequency manifold layer disposed at the bottom end of the antenna structure; and a second bottom dielectric spacer disposed between the second metal layer and the radio frequency manifold layer; and the second multilayer antenna unit comprises:

a first top metal layer disposed on the top surface of the central core layer and including a thickness substantially equal to a thickness of the first bottom metal layer;

a second top metal layer including a thickness substantially equal to a thickness of the second bottom metal layer;

a first top dielectric spacer separating the first top metal layer and the second top metal layer and including a thickness substantially equal to a thickness of the first bottom dielectric spacer; and a second top dielectric spacer disposed on an opposite side of the second top metal layer than the first top dielectric spacer and including a thickness substantially equal to a thickness of the second bottom dielectric spacer.

3. The antenna assembly of claim 2, wherein the first bottom metal layer, the first top metal layer, and the second top metal layer each comprise a corresponding antenna, and the second bottom metal layer comprises a ground plane shared by each of the antennas.

4. The antenna assembly of claim 3, wherein each of the antennas comprise a different metal pattern.

5. The antenna assembly of claim 4, further comprising one or more cross dipoles disposed electrically between metal patches defined by the metal pattern associated with at least one of the antennas.

6. The antenna assembly of claim 2, wherein the first and second bottom metal layers, the first and second top metal layers, and the radio frequency manifold layer are connected by at least one probe feed via extending between the top and bottom ends of the antenna board stack.

7. The antenna assembly of claim 2, wherein:

the first bottom dielectric spacer comprises:

a first bottom prepreg layer disposed on an opposite side of the first bottom metal layer than the central core layer;

a second bottom prepreg layer disposed on the second bottom metal layer; and a first bottom core layer disposed between the first bottom prepreg layer and the second bottom prepreg layer;

the second bottom dielectric spacer comprises:

a second bottom core layer disposed on an opposite side of the second bottom metal layer than the second bottom prepreg layer; and a third bottom prepreg layer disposed between the second bottom core layer and the radio frequency manifold layer;

the first top dielectric spacer comprises:

a first top prepreg layer disposed on an opposite side of the first top metal layer than the central core layer;

a second top prepreg layer disposed on the second top metal layer; and a first top core layer disposed between the first top prepreg layer and the second top prepreg layer; and the second top dielectric spacer comprises:

a second top core layer disposed on an opposite side of the second top metal layer than the second top prepreg layer; and a third top prepreg layer disposed on an opposite side of the second top core layer at the top end of the antenna board stack.

8. The antenna assembly of claim 7, wherein:

thicknesses of the first bottom core layer, the first top core layer, and the central core layer are substantially equal;

thicknesses of the second bottom core layer and the second top core layer are substantially equal;

thicknesses of the first and second bottom prepreg layers and the first and second top prepreg layers are substantially equal; and thicknesses of the third bottom prepreg layer and the third top prepreg layer are substantially equal.

9. The antenna assembly of claim 7, wherein the radio frequency manifold layer comprises a passive splitter/combiner formed by a conductive micro-strip line formed on the third bottom prepreg layer.

10. The antenna assembly of claim 7, further comprising a control routing conductive layer disposed between the second bottom core layer and the third bottom prepreg layer, the control routing conductive layer connected to the radio frequency manifold layer by a first controlled-depth via formed through the third bottom prepreg layer.

11. The antenna assembly of claim 10, wherein the radio frequency manifold layer is connected to the second bottom metal layer by a second controlled-depth via formed through the third bottom prepreg layer, the control routing conductive layer, and the second bottom core layer.

12. The antenna assembly of claim 1, further comprising one or more support members extending from the interior surface of the casing and into contact with the bottom end of the antenna board stack to define a bottom air-gap between the casing and the bottom end of the antenna board stack.

13. The antenna assembly of claim 1, wherein the radome is formed from one or more plastic materials.

14. The antenna assembly of claim 13, wherein the outer surface of the radome is coated with a hydrophobic material.

15. The antenna assembly of claim 1, wherein the radome and the top end of the printed circuit board are separated by a top air-gap.

16. The antenna assembly of claim 15, wherein the radome includes one or more support members extending from the inner surface configured to support the radome upon the top end of the antenna board stack and define the top air-gap separating the radome and the top end of the antenna board stack.

17. The antenna assembly of claim 1, wherein the outer surface of the radome is curved to facilitate water and snow run-off.

18. The antenna assembly of claim 1, wherein the radome and the antenna board stack are sloped relative to the inner and ground-engaging surfaces of the casing to facilitate water and snow run-off.

19. The antenna assembly of claim 18, wherein the antenna board stack is rotated about a center axis by an amount corresponding to the slope of the antenna board stack to place a grating lobe furthest away at a widest scan angle of the antenna board stack.

20. A phased-array antenna comprising:

a central core layer of a stacked printed circuit board including a bottom surface and a top surface disposed on an opposite side of the central core layer than the bottom surface;

a bottom portion of the stacked printed circuit board defining a bottom thickness extending between the bottom surface of the central core layer and a bottom end of the stacked printed circuit board, the bottom portion comprising a first antenna layer in opposed direct contact with the bottom surface of the central core layer and a ground plane layer spaced apart from both the first antenna layer and the bottom end of the stacked printed circuit board; and a top portion of the stacked printed circuit board defining a top thickness extending between the top surface of the central core layer and a top end of the stacked printed circuit board, the top portion comprising a second antenna layer in opposed direct contact with the top surface of the central core layer and a third antenna layer spaced apart from the second antenna layer and separated from the top surface of the central core layer by a distance substantially equal to a distance the ground plane layer is separated from the bottom surface of the central core layer, wherein the top thickness defined by the top portion of the stacked printed circuit board and the bottom thickness defined by the bottom portion of the stacked printed circuit board are substantially equal.

21. The phased-array antenna of claim 20, wherein the first, second, and third antenna layers each comprise an associated metal patch pattern.

22. The phased-array antenna of claim 21, wherein at least one of the metal patch patterns associated with the first, second, or third antenna layers is different.

23. The phased-array antenna of claim 21, further comprising one or more cross-dipoles placed electrically between metal patches of at least one of the antenna layers to produce electric field lines in a first direction and a second direction orthogonal to the first direction.

24. The phased-array antenna of claim 20, further comprising:

a first bottom dielectric layer separating the first antenna layer and the ground plane layer;

a radio frequency manifold layer disposed at the bottom end of the stacked printed circuit board;

a second bottom dielectric layer separating the radio frequency manifold layer and the ground plane layer;

a first top dielectric layer separating the second antenna layer and the third antenna layer; and a second top dielectric layer disposed at the top end of the stacked printed circuit board.

25. The phased-array antenna of claim 24, wherein the first top dielectric layer and the first bottom dielectric layer comprise a dielectric thickness different than the dielectric thickness of the second top dielectric layer and the second bottom dielectric layer.

26. The phased-array antenna of claim 24, wherein the first bottom dielectric layer, the first top dielectric layer, the second bottom dielectric layer, and the second top dielectric layer are formed from printed circuit board materials.

27. The phased-array antenna of claim 24, wherein the radio frequency manifold layer, the ground plane layer, the first antenna layer, the second antenna layer, and the third antenna layer are connected by at least one probe feed via extending between the top and bottom ends of the stacked printed circuit board.

28. The phased-array antenna of claim 24, wherein the radio frequency manifold layer and the ground plane layer are connected by a first controlled-depth via formed through the second bottom dielectric layer.

29. The phased-array antenna of claim 24, further comprising a control routing conductive layer formed within the second bottom dielectric layer and connected to the radio frequency manifold layer by a second controlled-depth via formed through a portion of the second bottom dielectric layer between the control routing conductive layer and the radio frequency manifold layer.

30. The phased-array antenna of claim 29, wherein at least one of the control routing conductive layer or the radio frequency manifold layer is formed by a conductive micro-strip line printed on the second bottom dielectric layer.

* * * * *